US009534455B2

(12) United States Patent
Peters et al.

(10) Patent No.: US 9,534,455 B2
(45) Date of Patent: Jan. 3, 2017

(54) SHOULDER RING FOR TRANSMISSION LINE AND TRANSMISSION DEVICES

(71) Applicants: Volker Peters, Wienhausen (DE); Detlev Benedict, Celle (DE); Robert Buda, Lower Saxony (DE); Stephan Mueller, Hannover (DE); Henning Rahn, Celle (DE); Rene Schulz, Lower Saxony (DE)

(72) Inventors: Volker Peters, Wienhausen (DE); Detlev Benedict, Celle (DE); Robert Buda, Lower Saxony (DE); Stephan Mueller, Hannover (DE); Henning Rahn, Celle (DE); Rene Schulz, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 289 days.

(21) Appl. No.: 13/948,303

(22) Filed: Jul. 23, 2013

(65) Prior Publication Data

US 2015/0027685 A1 Jan. 29, 2015

(51) Int. Cl.

| | |
|---|---|
| ***E21B 17/042*** | (2006.01) |
| ***E21B 17/02*** | (2006.01) |
| ***E21B 17/03*** | (2006.01) |

(52) U.S. Cl.

CPC ..... *E21B 17/042* (2013.01); *E21B 17/028* (2013.01); *E21B 17/03* (2013.01)

(58) Field of Classification Search

CPC ..... E21B 17/028; E21B 17/042

See application file for complete search history.

(56) References Cited

U.S. PATENT DOCUMENTS

| | | | | |
|---|---|---|---|---|
| 4,445,734 | A * | 5/1984 | Cunningham | H01R 13/523 439/194 |
| 4,605,268 | A * | 8/1986 | Meador | 439/194 |
| 4,842,207 | A | 6/1989 | Kinnan | |
| 4,884,071 | A * | 11/1989 | Howard | 340/854.8 |
| 6,670,880 | B1 * | 12/2003 | Hall | E21B 17/028 336/132 |
| 6,981,546 | B2 | 1/2006 | Hall et al. | |
| 7,114,970 | B2 * | 10/2006 | Head | 439/191 |
| 7,299,867 | B2 | 11/2007 | Hall et al. | |
| 7,852,232 | B2 | 12/2010 | Hall et al. | |
| 8,118,093 | B2 | 2/2012 | Hassell et al. | |

(Continued)

FOREIGN PATENT DOCUMENTS

WO 2008027047 A1 3/2008

OTHER PUBLICATIONS

International Search Report and Written Opinion for PCT Application No. PCT/US2014/047790, dated Nov. 7, 2014, pp. 1-15.

*Primary Examiner* — Robert E Fuller
(74) *Attorney, Agent, or Firm* — Cantor Colburn LLP

(57) ABSTRACT

A tubular section and a system including the tubular section include a first tubular member including a threaded pin section and a second tubular member, the second tubular member including a threaded box section configured to mate with the threaded pin section. The tubular section also includes a shoulder ring disposed between the first tubular member and the second tubular member, wherein a wall thickness of at least a portion of the shoulder ring is greater than a smallest wall thickness of the threaded pin section of the first tubular member.

17 Claims, 9 Drawing Sheets

(56) References Cited

U.S. PATENT DOCUMENTS

| | | | | |
|---|---|---|---|---|
| 8,242,928 | B2 | 8/2012 | Prammer | |
| 2005/0001736 | A1 | 1/2005 | Hall et al. | |
| 2006/0113086 | A1* | 6/2006 | Costa et al. | 166/380 |
| 2009/0166087 | A1 | 7/2009 | Braden et al. | |
| 2010/0071188 | A1 | 3/2010 | Madhavan et al. | |
| 2010/0111592 | A1* | 5/2010 | Hassell et al. | 403/24 |
| 2011/0057810 | A1* | 3/2011 | Partouche | 340/854.4 |
| 2012/0274477 | A1 | 11/2012 | Prammer | |
| 2014/0148029 | A1* | 5/2014 | Mueller et al. | 439/191 |

* cited by examiner

SHOULDER RING FOR TRANSMISSION LINE AND TRANSMISSION DEVICES

BACKGROUND

In downhole exploration and production systems, a transmission line is often used in drill pipes and with downhole tools to convey data and instructions downhole or uphole. Sections of pipes that are coupled together to extend the downhole reach of the equipment are often configured as mating pin and box pairs that thread together. Because the threads on both the pin and box sides must sometimes be re-machined, the unthreaded portion at the tip of the pin as well as at the box thread runout follow geometric rules and limitations with regard to radial design space.

SUMMARY

According to one aspect of the invention, a tubular section in a borehole penetrating the earth includes a first tubular member including a threaded pin section; a second tubular member, the second tubular member including a threaded box section configured to mate with the threaded pin section; and a shoulder ring disposed between the first tubular member and the second tubular member, wherein a wall thickness of at least a portion of the shoulder ring is greater than a smallest wall thickness of the threaded pin section of the first tubular member.

According to another aspect of the invention, a system to convey a tool into a borehole penetrating the earth and transfer information from the tool to another location in the borehole or to a surface of the earth includes a tubular section interfacing with the tool, the tubular section including a first tubular member including a threaded pin section; a second tubular member, the second tubular member including a threaded box section configured to mate with the threaded pin section; and a shoulder ring disposed between the first tubular member and the second tubular member, wherein a wall thickness of at least a portion of the shoulder ring is greater than the smallest wall thickness of the threaded pin section of the first tubular member.

BRIEF DESCRIPTION OF THE DRAWINGS

Referring now to the drawings wherein like elements are numbered alike in the several Figures:

FIG. 13 is a cross-sectional illustration of a borehole including connected tubular members according to an embodiment of the invention.

DETAILED DESCRIPTION

Figure 1:
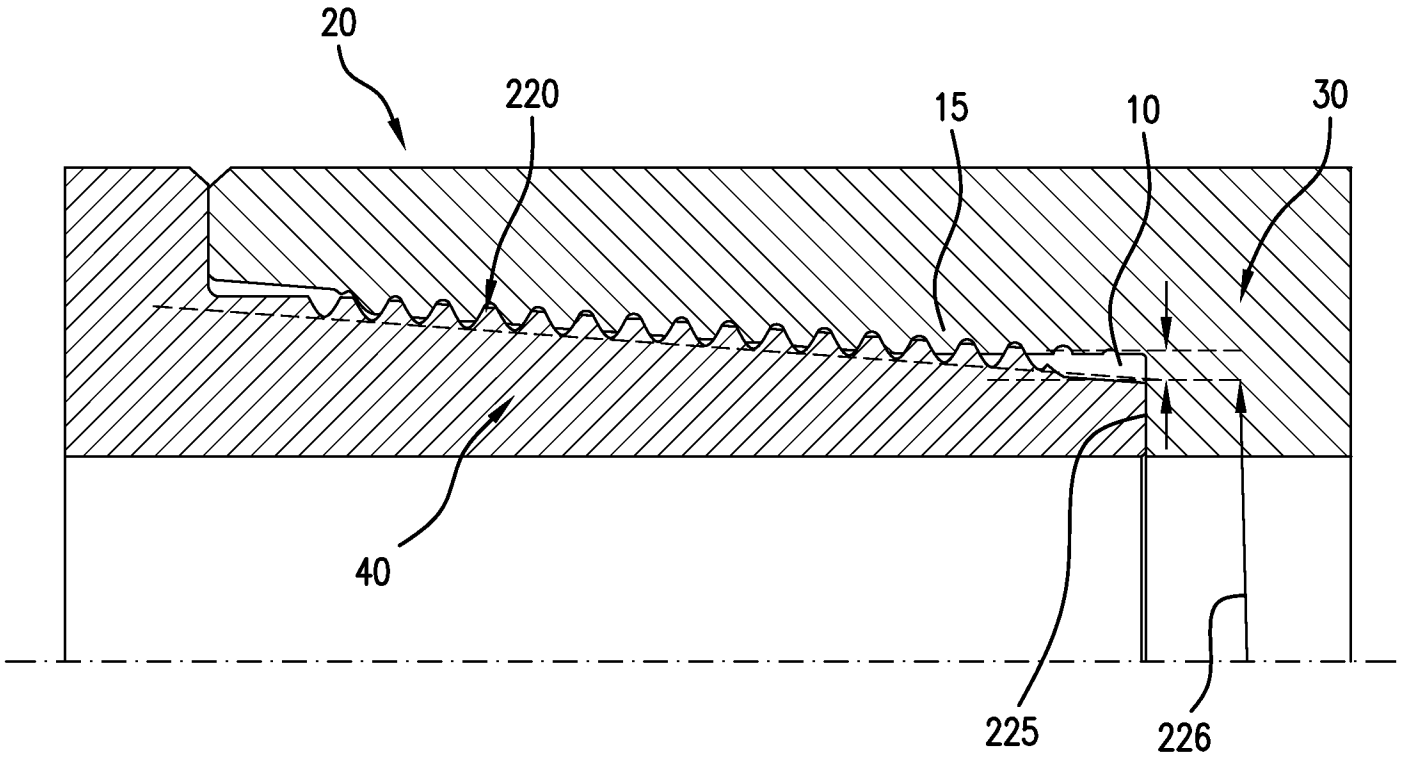
FIG. 1 is a cross-sectional view of a tapered threaded tubular section.

FIG. 1 is a cross-sectional view of a tapered threaded tubular section 20. As FIG. 1 illustrates, when the pin thread 220 of the pin 40 and the threaded portion 15 extending from the box 30 are matched up, there may be a gap 10 at the tip of the pin 40. This radial space or gap 10 at the tip of the pin 40 is defined by the thread (220, 15) profile geometry and the angle of the thread (220, 15) taper. Manufacturing of the tapered thread (220, 15) as well as repair of the thread (220, 15) by means of thread recut limits the pin 40 to a certain maximum radius 226 at the end of the pin 40. This limitation additionally limits the thickness at the pin 40 end to take into consideration the competing interests of material strength (which suggests greater thickness) and design space of the pin end 225 (which suggests reduced thickness). Embodiments of the system described herein facilitate using some radial space or the gap 10 between the pin 40 and the box 30 as installation space for devices (e.g., retention mechanism, coupler) by inserting a shoulder ring 210 (see e.g., FIG. 2). During repair and recut operation the shoulder ring 210 can be removed from the threaded pin and be reinstalled. As detailed below, embodiments of the shoulder ring 210 may be used for a transmission line or for a transmission device. A transmission line includes a conductor channel (tube) and a conductor (e.g., optical fiber, coaxial cable, twisted pair wires, individual wire). A mechanical clamp affixes the conductor channel to the tool body (e.g., 1310 FIG. 13).

Figure 2:
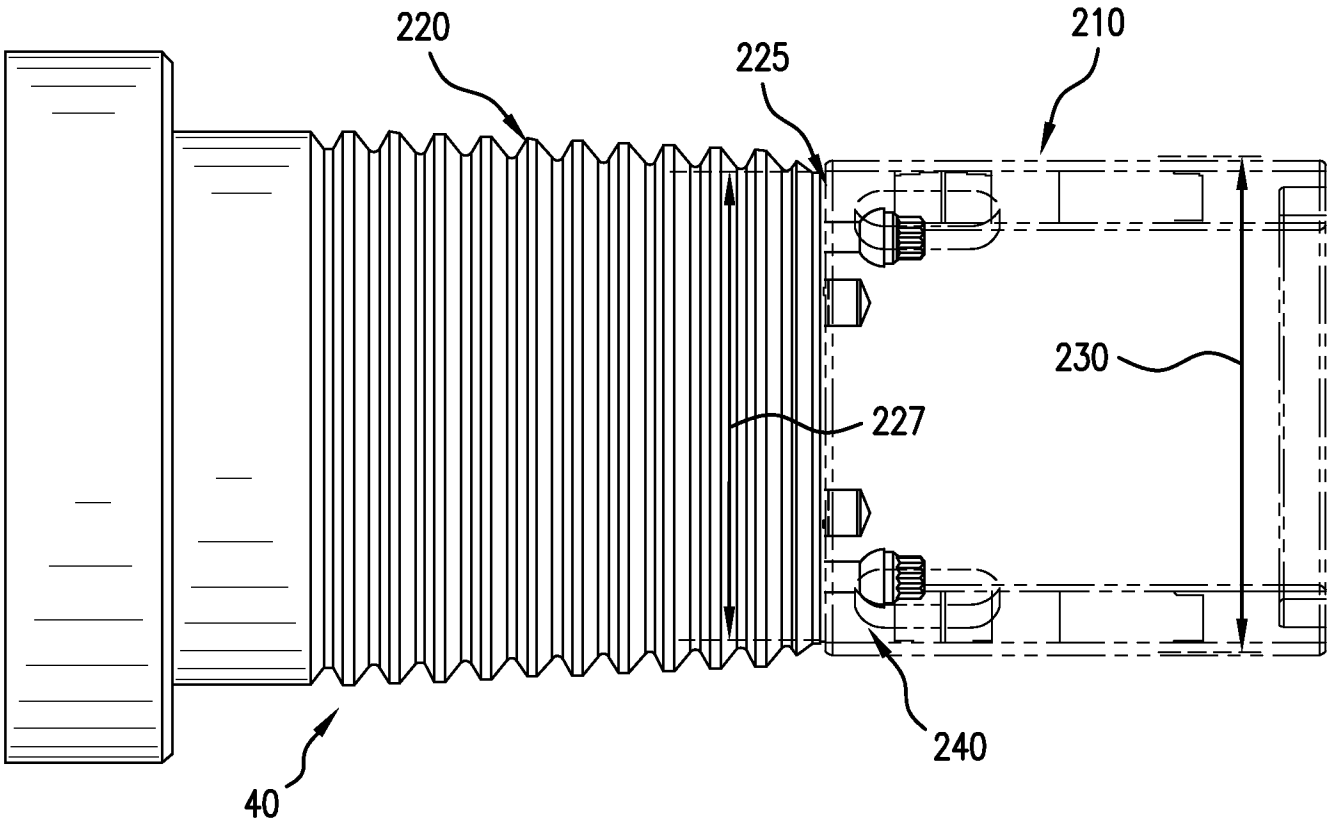
FIG. 2 depicts a shoulder ring placed onto a pin thread according to an embodiment of the invention.
Figure 3:
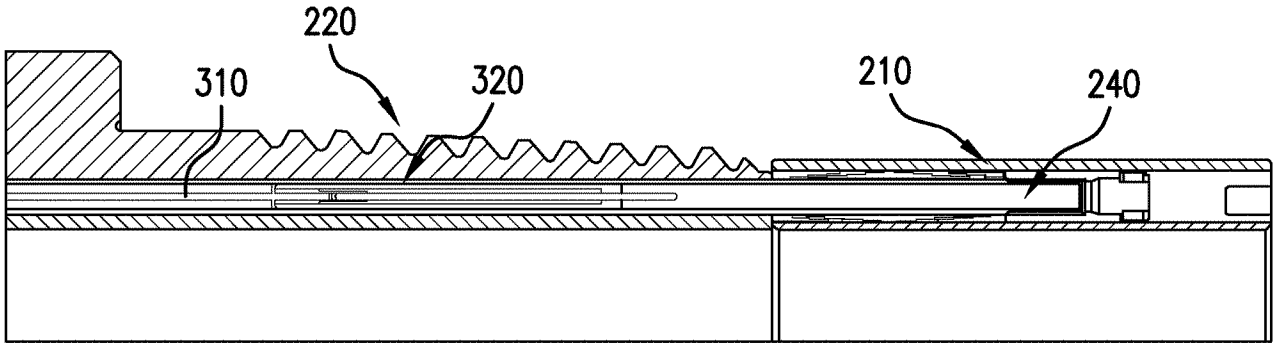
FIG. 3 is a cross-sectional view of the pin thread and shoulder ring shown in FIG. 2.

FIG. 2 depicts a shoulder ring 210 placed onto a pin thread 220 according to an embodiment of the invention. The shoulder ring 210 extends from the pin end 225. The outer diameter 230 of the shoulder ring 210 is facilitated to be larger than maximum diameter 227 (2*maximum radius 226, FIG. 1) at the pin 40 end. The inside of the shoulder ring 210 is visible in FIGS. 2 and 3. Within the shoulder ring 210, a conductor channel 240 is fixed to the shoulder ring 210. The conductor channel 240 may be put in tension through the pin 40 side. FIG. 3 is a cross-sectional view of the pin thread 220 and shoulder ring 210 shown in FIG. 2. The view shown by FIG. 3 includes the wire 310 and a length compensating connector 320. The greater volume provided by the shoulder ring 210 (as compared to the volume within the pin end 225 in FIG. 1, for example) facilitates space for coupler geometry or the retention mechanism of the conductor channel 240, for example.

Figure 4:
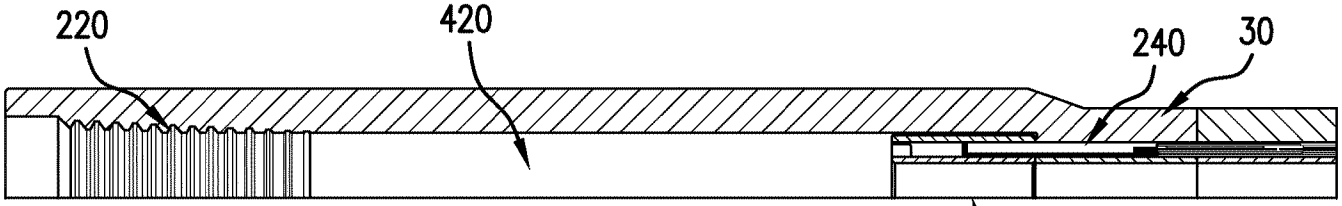
FIG. 4 depicts a shoulder ring in the box according to an embodiment of the invention.

FIG. 4 depicts a shoulder ring 210 in the box 30 according to an embodiment of the invention. The space 420 between the shoulder ring 210 and the pin thread 220 may be occupied by an electrical frame and/or another shoulder ring 210. The conductor channel 240 may be affixed to the shoulder ring 210 through clamping, threading, welding, soldering, gluing, or by some other mechanism. Because the coupler geometry need not be cut into the tool body and the coupler may instead be in the shoulder ring 210, the manufacturing of the drilling or downhole tool (see e.g. 1310 in FIG. 13) may be made easier through the use of the shoulder ring 210. In addition, the shoulder ring 210 is made exchangeable or relatively easier to replace in case of wear or damage of a shoulder in the tool body or the shoulder ring 210 than if it were part of the tool body. The conductor channel 240 may be pre-assembled to the shoulder ring 210 prior to final assembly. Also, the shoulder ring 210 may be made of a different material than the pin 40 or box 30. The shoulder ring 210 may be a higher strength material than the other components and may have sufficient strength to carry shoulder thread loads and operational loads. The shoulder ring 210 may also be made of a corrosion resistant material to prevent corrosion initiated failures at, for example, the sealing area of the coupler electrical connection. By using a non galling material for the shoulder ring 210, galling damage may be prevented during thread makeup.

Figure 5:
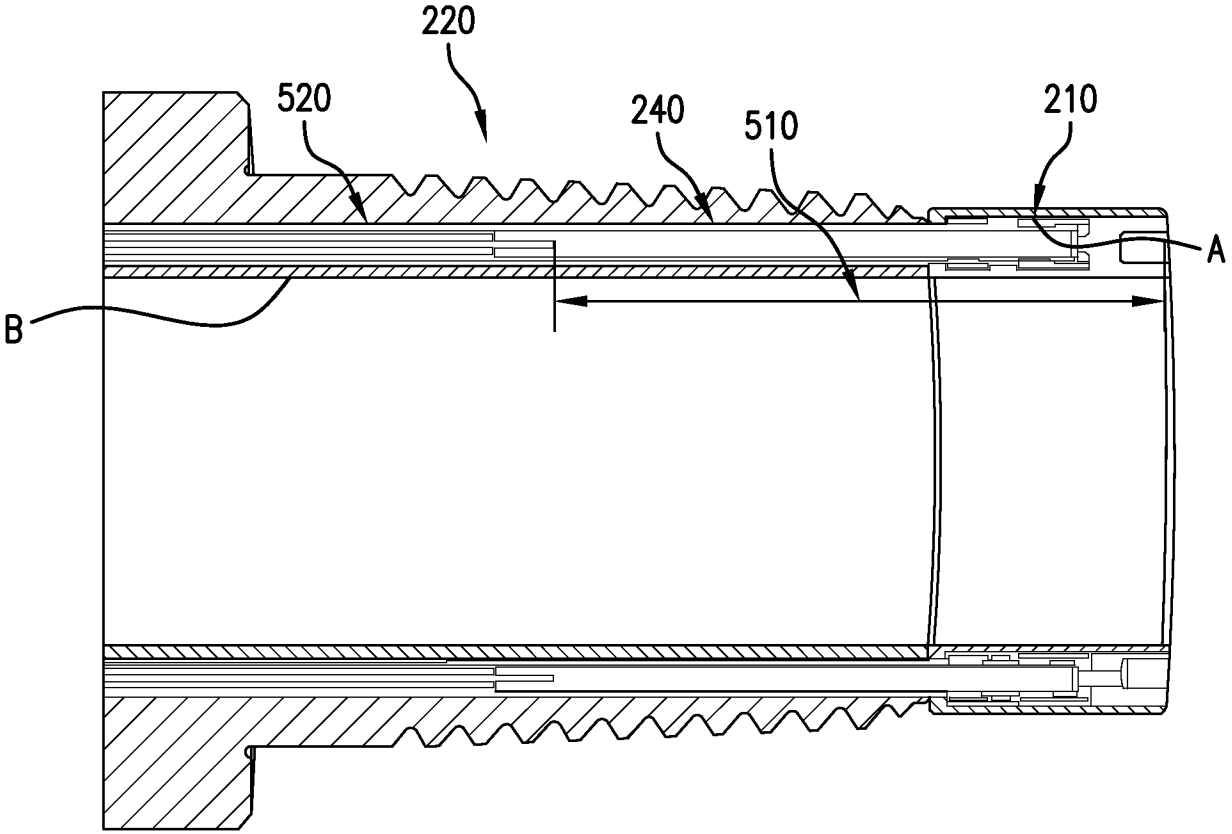
FIG. 5 is a cross-sectional view of a pin shoulder ring according to an embodiment of the invention.
Figure 6:
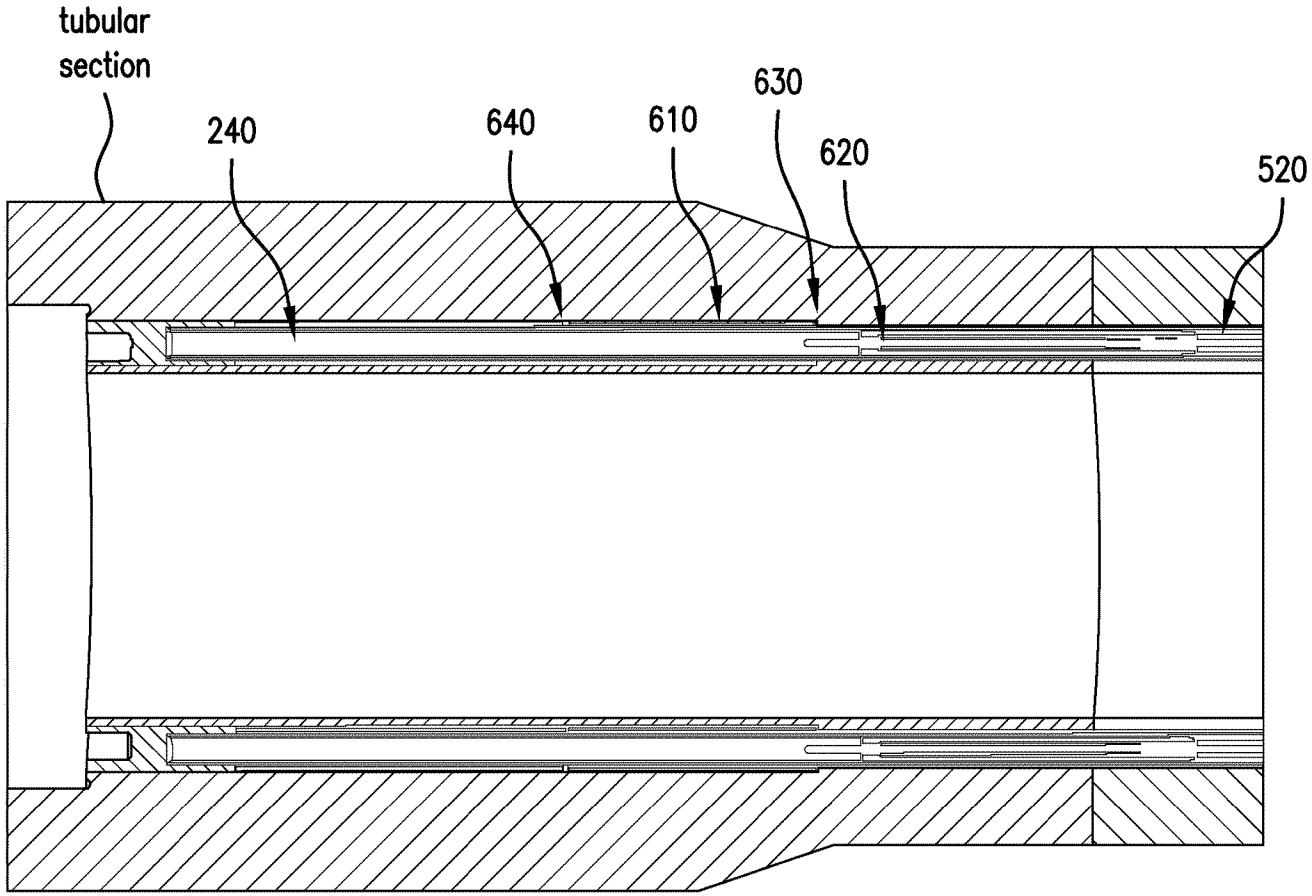
FIG. 6 is a cross-sectional view of a box end of a part-assembled tubular section according to an embodiment of the invention.

FIG. 5 is a cross-sectional view of a pin shoulder ring 210 according to an embodiment of the invention. While the embodiment of FIG. 4 includes space 420 between the pin thread 220 and shoulder ring 210, in the embodiment of FIG. 5, the axial length of the pin thread 220 may be reduced compared to the one displayed in FIG. 2, for example, and the space 420 may be eliminated. The transmission line 520 (conductor channel 240 (FIG. 2)) with wire 310 (FIG. 3)) is fed through the box side of the downhole tool. FIG. 6 is a cross-sectional view of a box end of a part-assembled tubular section according to an embodiment. FIG. 6 details components of the transmission device. The components include an axial load sleeve 640 and a sleeve 610. The sleeve 610 is chosen to adjust the axial length 510 (FIG. 5) of the conductor channel 240 with respect to the drillpipe internal shoulder distance that changes after e.g. recut operations. Through the use of the sleeve 610, the need for precise tolerances that may change, based on recutting, for example, is eliminated. In the embodiment shown in FIG. 6, a shoulder 630 is cut directly into the drill pipe material to hold the conductor channel 240.

Figure 7:
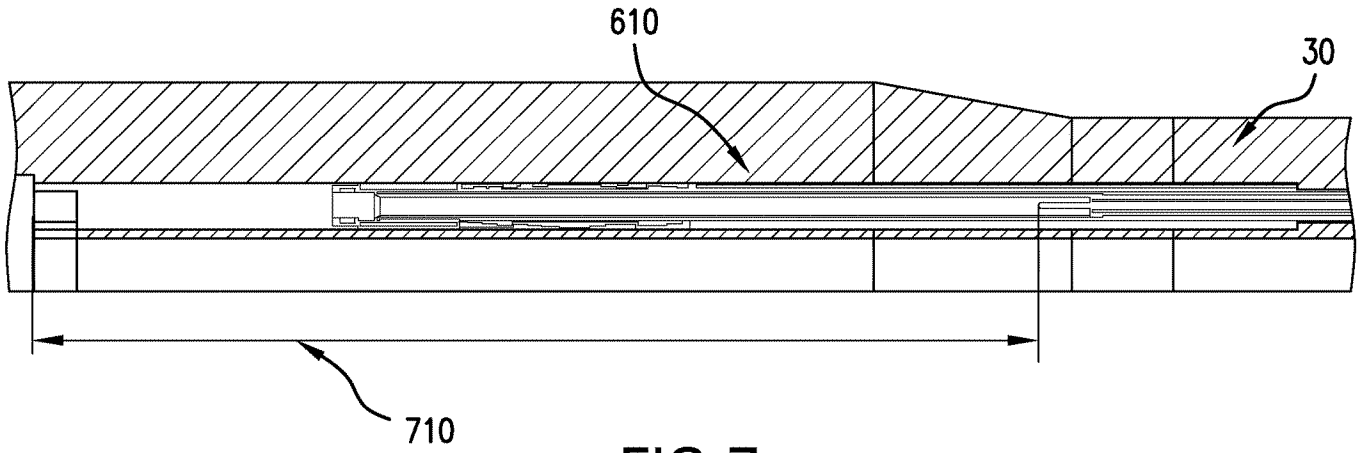
FIGS. 7 and 8 show inserts in the box end according to embodiments of the invention.
Figure 8:
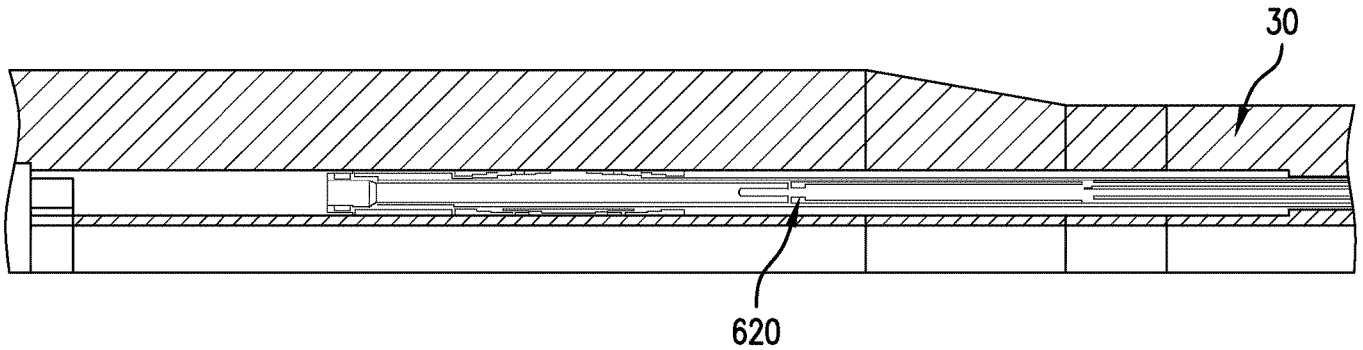

FIGS. 7 and 8 show inserts in the box 30 end according to embodiments of the invention. The length compensation connector 620 (FIGS. 6 and 8) may be chosen such that the variation in length 710 (FIG. 7) after recut is eliminated and set to a fixed distance between the box 30 and connection position of the length compensation connector 620. The sleeve 610 sits between a machined shoulder 630 of the downhole tool (1310, FIG. 13) and a load sleeve 640 on the transmission line 520. The machined shoulder 630 of the downhole tool 1310 may be straight or inclined. When inclined, the machined shoulder 630 facilitates forming a clamping set and thereby preventing any motion of the transmission line 520.

Figure 9B:
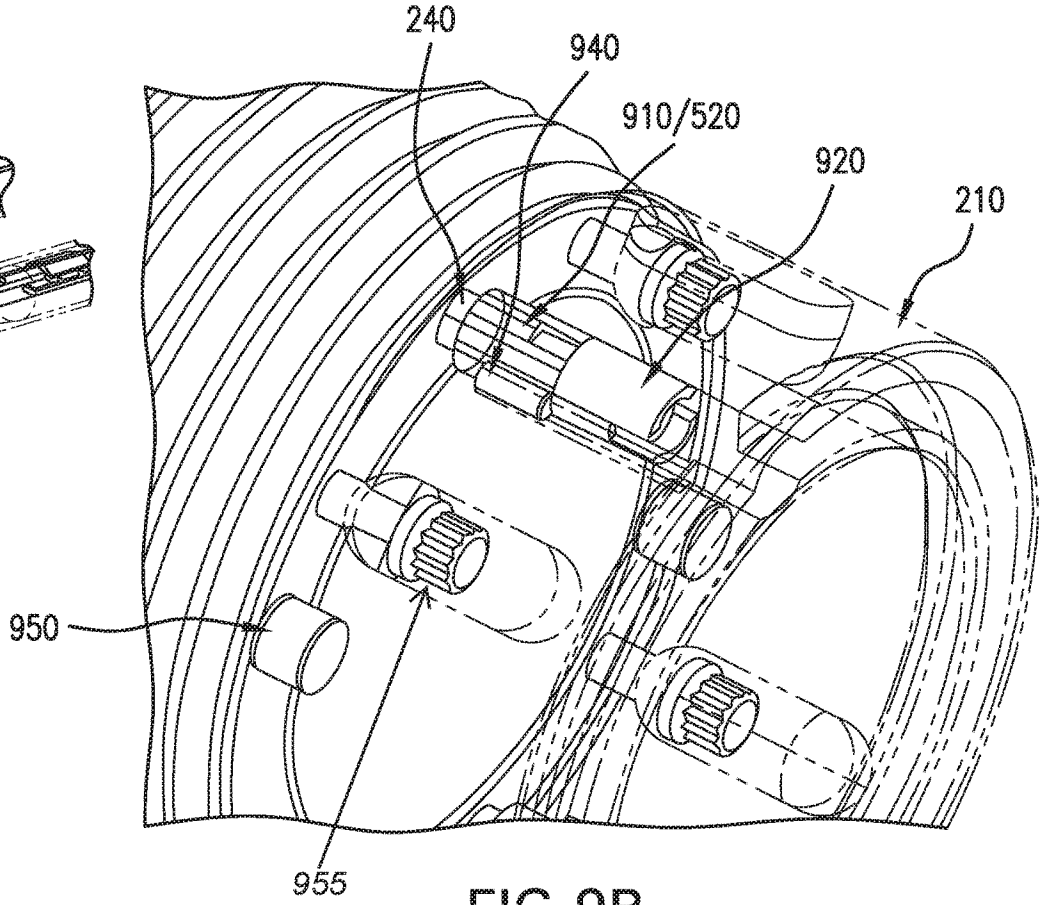
FIG. 9 depicts a detailed view of parts within the shoulder ring according to embodiments of the invention.
Figure 9A:
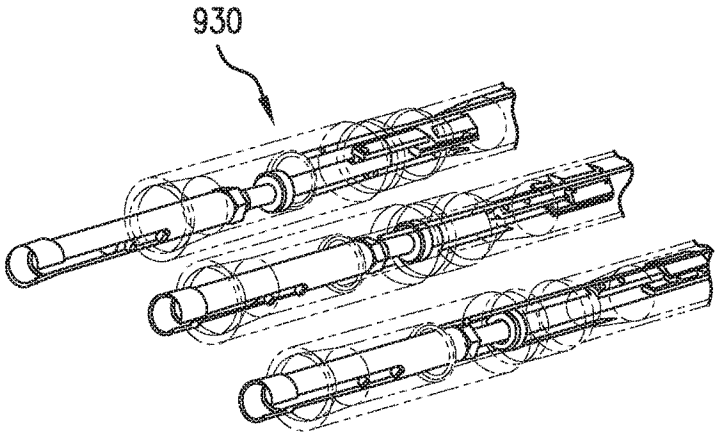

FIG. 9 depicts a detailed view of parts within the shoulder ring 210 according to embodiments of the invention. The transmission line 520 may be fixed to a drilling tool using a nut 910. The transmission line 520 may be elongated by a tensioning device 930 inserted through the pin side of the downhole tool. The nut 910 is assembled onto the threaded end of the transmission line and has to be blocked from rotating with respect to the shoulder ring 210 through the use of a lock pin 940, for example. A second nut 920 mounted behind the nut 910 and torqued upon the nut 910 prevents the locking device from backing off during the drilling operation. The tensioning device 930 may be removed further on. Alternatively, the transmission line 520 may be set in tension using the threaded end of the transmission line 520 and the nut 910. The pin 950 and/or screw 955 prevent the pin shoulder ring 210 from rotating when the drill pipe thread is being torqued. The pin 950 is sized to transfer this torque and to protect the conductor channel 240.

Figure 11:
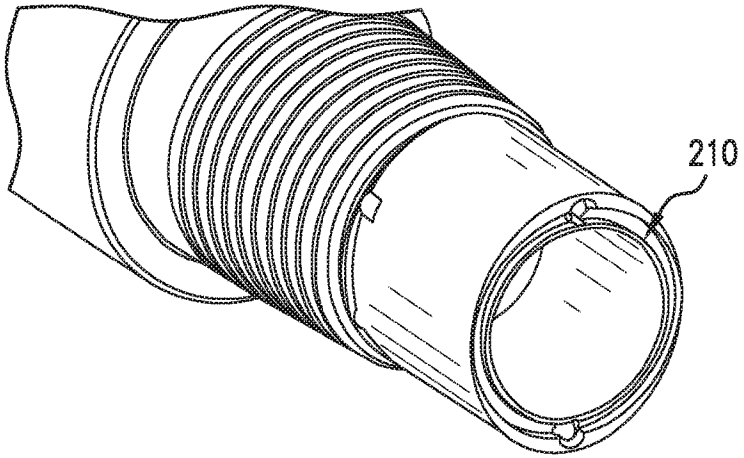
FIGS. 10-12 depict views of an embodiment of a shoulder ring.
Figure 10:
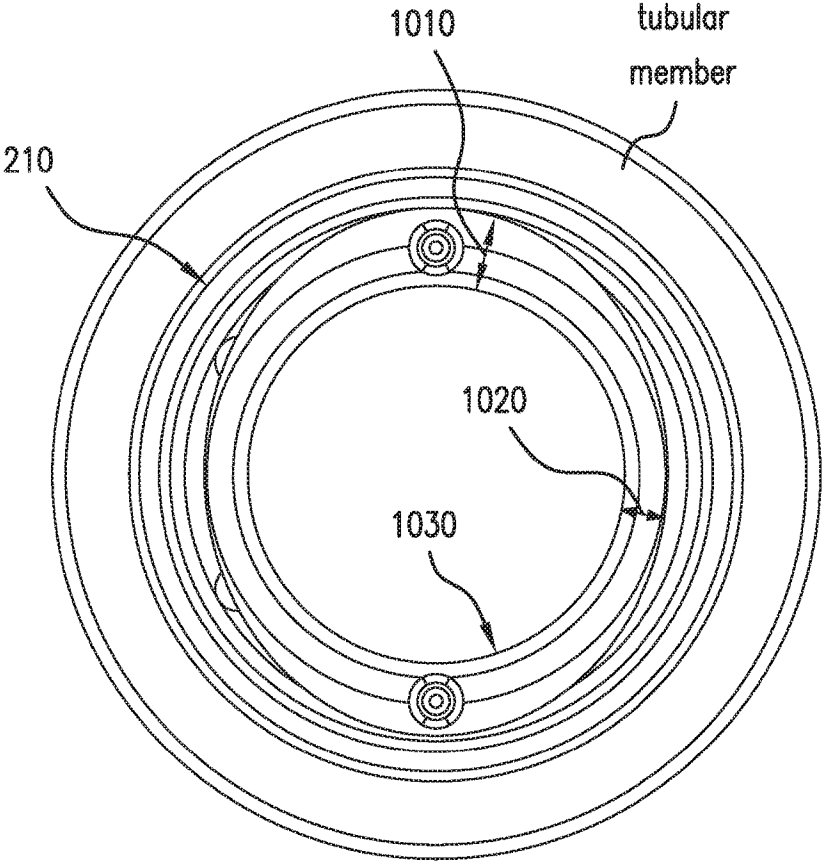
Figure 12:
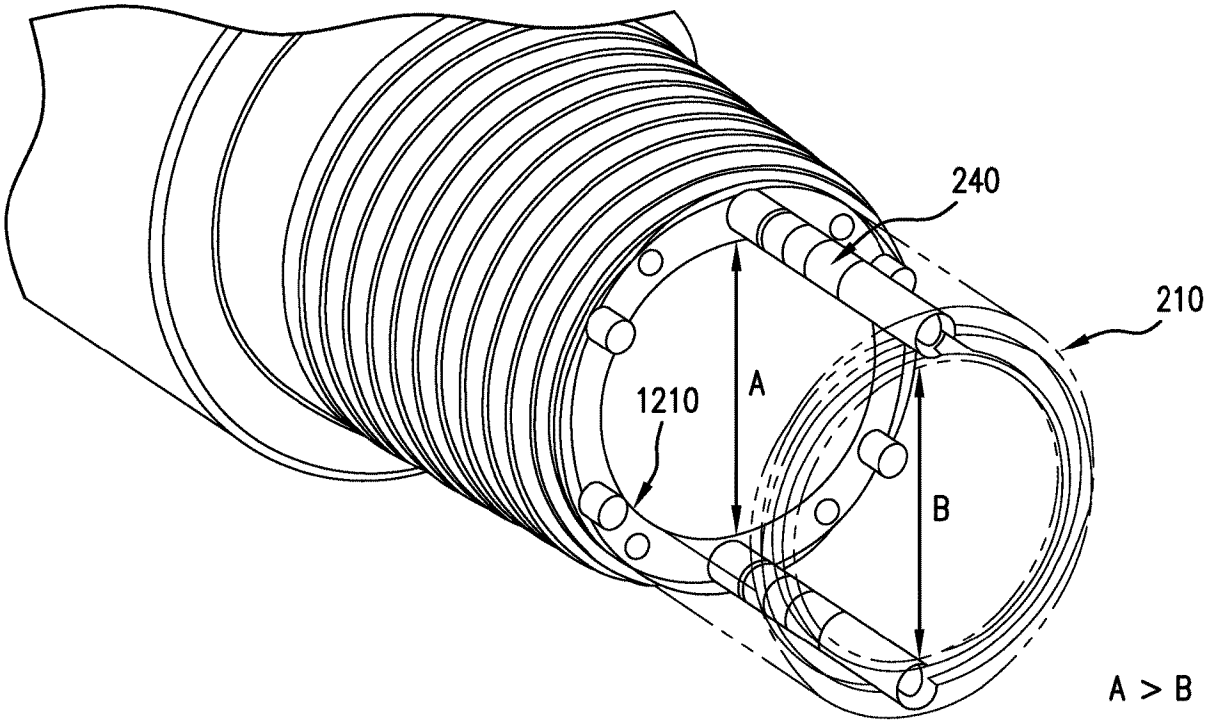

FIGS. 10-12 depict views of an embodiment of a shoulder ring 210. The embodiment shown by FIGS. 10-12 is of a shoulder ring 210 with non-uniform thickness. As shown in FIG. 10, the thickness 1010 and the thickness 1020 at different parts of the shoulder ring 210 are not the same. This non-uniform thickness facilitates a larger groove to be located at the thicker portions of the shoulder ring 210 for a transmission line 520 that may carry more conductors or larger conductors than a typical transmission line 520, for example. The non-uniform thickness may result in an inner radius of a portion (e.g., thickest portion) of the shoulder ring 210 being smaller than an inner radius of a smallest part of the threaded pin section (1210, FIG. 12). The view shown by FIG. 11 indicates that the outside of the shoulder ring 210 still has a circular cross-sectional shape while the thickness (thus the inner cross sectional shape) is non-uniform. The view shown by FIG. 12 includes conductor channels 240 within the shoulder ring 210. One or more conductor channels 240 may be larger or there may be more than one conductor channel 240 in a particular part of the shoulder ring 210 based on the thickness of that particular part.

FIG. 13 is a cross-sectional illustration of a borehole 1 including connected tubular members 1320, 1330 according to an embodiment of the invention. A borehole 1 penetrates the earth 3 including a formation 4. The tubular members 1320, 1330 disposed in the borehole 1 are connected by a threaded portion. One or more shoulder rings 210 may be included at different places between the tubular members 1320, 1330 as shown in the embodiments of FIG. 3 and FIG. 4, for example. Information from downhole tools 1310 such as sensors, measurement devices, or drilling tools may be telemetered or transmitted to a surface processing device 130 or any other location in the borehole. The box portion may correspond with the tool 1310 such that the shoulder ring 210 is between the tool 1310 and the tubular segment 1330, as also shown in FIG. 10. Other components may be included between the tubular members 1320, 1330 in addition to the shoulder ring 210 for various other purposes.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubular section in a borehole penetrating the earth, the tubular section comprising:

a first tubular member including a threaded pin section with a plurality of threads;

a second tubular member, the second tubular member including a threaded box section configured to mate with the threaded pin section; and a shoulder ring disposed between the first tubular member and the second tubular member, an end of the shoulder ring being in contact with an end of the threaded pin section of the first tubular member over the entire circumference of the end of the threaded pin section and a same axial line going through the center of the shoulder ring, the center of the first tubular member, and the center of the second tubular member, wherein a wall thickness of at least a portion of the shoulder ring is greater than a smallest wall thickness of the threaded pin section of the first tubular member and an outer radius of the shoulder ring is greater than a smallest outer radius between a pair of the plurality of threads in the threaded pin section, wherein the shoulder ring is fixed to at least one of the first tubular member and the second tubular member using a threaded nut or a screw.

2. The tubular section according to claim 1, further comprising a conductor channel traversing through the tubular section and carrying a conductor from a tool downhole to another location in the borehole or to a surface of the earth.

3. The tubular section according to claim 2, wherein the shoulder ring includes a retention mechanism to retain the conductor channel traversing within the shoulder ring.

4. The tubular section according to claim 2, further comprising one or more length compensation connectors to accommodate a length of the conductor.

5. The tubular section according to claim 2, wherein the conductor channel or the conductor is put in tension through the threaded pin section side of the tubular section.

6. The tubular section according to claim 2, wherein the conductor channel is put in tension through the threaded box section side of the tubular section.

7. The tubular section according to claim 1, wherein the shoulder ring is disposed axially between at least one box shoulder and the threaded pin section.

8. The tubular section according to claim 1, wherein the shoulder ring includes a non galling material.

9. The tubular section according to claim 1, wherein the shoulder ring is made of a different material than the first tubular member or the second tubular member.

10. The tubular section according to claim 1, wherein the shoulder ring includes corrosion resistant material.

11. The tubular section according to claim 1, wherein a perimeter of a cross section of the shoulder ring is circular.

12. The tubular section according to claim 1, wherein the shoulder ring is detachable from the first tubular member and the second tubular member.

13. A system to convey a tool into a borehole penetrating the earth and transfer information from the tool to another location in the borehole or to a surface of the earth, the system comprising: a tubular section interfacing with the tool, the tubular section comprising a first tubular member including a threaded pin section with a plurality of threads; a second tubular member, the second tubular member including a threaded box section configured to mate with the threaded pin section; and a shoulder ring disposed between the first tubular member and the second tubular member, an end of the shoulder ring being in contact with an end of the threaded pin section of the first tubular member over the entire circumference of the end of the threaded pin section and a same axial line going through the center of the shoulder ring, the center of the first tubular member, and the center of the second tubular member, wherein a wall thickness of at least a portion of the shoulder ring is greater than the smallest wall thickness of the threaded pin section of the first tubular member and an outer radius of the shoulder ring is greater than a smallest outer radius between a pair of the plurality of threads in the threaded pin section, wherein the shoulder ring is fixed to at least one of the first tubular member and the second tubular member using a threaded nut or a screw.

14. The system according to claim 13, further comprising a conductor channel enclosed within the tubular section and carrying a conductor from the tool to the another location in the borehole or to the surface of the earth, wherein the shoulder ring includes a retention mechanism to retain the conductor channel traversing within the shoulder ring.

15. The system according to claim 14, wherein the conductor channel is put in tension through the threaded pin section side of the tubular section.

16. The system according to claim 14, wherein the conductor channel is put in tension through the threaded box section side of the tubular section.

17. The system according to claim 13, wherein the shoulder ring is detachable from the first tubular member and the second tubular member.

* * * * *